US010138674B2

(12) United States Patent
Hsu et al.

(10) Patent No.: US 10,138,674 B2
(45) Date of Patent: Nov. 27, 2018

(54) CONTROL DEVICE FOR CORDLESS BLINDS ASSEMBLY

(71) Applicant: CHING FENG HOME FASHIONS CO., LTD, Fuxing Shiang, Changhua County (TW)

(72) Inventors: Sheng Ying Hsu, Fuxing Shiang (TW); Chun Jan Hsu, Fuxing Shiang (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 156 days.

(21) Appl. No.: 15/237,476

(22) Filed: Aug. 15, 2016

(65) Prior Publication Data

US 2017/0218695 A1 Aug. 3, 2017

(30) Foreign Application Priority Data

Jan. 28, 2016 (TW) ..... 105201377 U

(51) Int. Cl.
*E06B 9/322* (2006.01)
*E06B 9/32* (2006.01)

(52) U.S. Cl.
CPC ..... *E06B 9/322* (2013.01); *E06B 9/32* (2013.01); *E06B 2009/3222* (2013.01)

(58) Field of Classification Search
CPC ... E06B 9/322; E06B 9/325; E06B 2009/3222
USPC ..... 160/84.04, 84.01, 84.05, 170, 168.1 R, 160/173 R
See application file for complete search history.

(56) References Cited

U.S. PATENT DOCUMENTS 2,824,608 A * 2/1958 Etten ..... E06B 9/322 160/170
6,024,154 A * 2/2000 Wang ..... E06B 9/322 160/168.1 R
6,644,372 B2 * 11/2003 Judkins ..... E06B 9/32 160/170
6,675,861 B2 * 1/2004 Palmer ..... E06B 9/322 160/170
6,684,930 B2 * 2/2004 Palmer ..... E06B 9/322 160/170
6,761,202 B1 * 7/2004 Cheng ..... E06B 9/322 160/170
7,117,919 B2 * 10/2006 Judkins ..... E06B 9/32 160/170
8,739,853 B2 * 6/2014 Judkins ..... E06B 9/322 160/170
8,887,786 B2 * 11/2014 Anderson ..... E06B 9/32 160/167 R
9,314,125 B2 * 4/2016 Anthony ..... A47H 5/032
9,357,868 B2 * 6/2016 Anderson ..... E06B 9/322
9,422,766 B2 * 8/2016 Anderson ..... E06B 9/324
9,482,048 B2 * 11/2016 Anderson ..... E06B 9/262
9,677,330 B2 * 6/2017 Anderson ..... E06B 9/322
(Continued)

*Primary Examiner* — Katherine W Mitchell
*Assistant Examiner* — Johnnie A. Shablack
(74) *Attorney, Agent, or Firm* — Che-Yang Chen; Law Offices of Scott Warmuth

(57) ABSTRACT

A control device of a cordless blinds assembly includes a bottom box and a rod unit which is received in the bottom box. The rod unit is cooperated with the operation unit in the bottom box. The operation unit is cooperated with a pawl which is engaged with or disengaged from a gear of the coil spring plate seat so as to control the operation of the blinds assembly without using any operation cord.

8 Claims, 9 Drawing Sheets

(56) References Cited

U.S. PATENT DOCUMENTS

| | | | | |
|---|---|---|---|---|
| 9,702,184 | B2 * | 7/2017 | Gilmer | E06B 9/304 |
| 9,708,850 | B2 * | 7/2017 | Anderson | E06B 9/322 |
| 9,845,639 | B2 * | 12/2017 | Chen | E06B 9/322 |
| 2003/0111191 | A1 * | 6/2003 | Ciuca | E06B 9/322 160/170 |
| 2008/0000592 | A1 * | 1/2008 | Huang | E06B 9/322 160/170 |
| 2014/0048220 | A1 * | 2/2014 | Cheng | E06B 9/24 160/368.1 |
| 2015/0020982 | A1 * | 1/2015 | Anderson | E06B 9/324 160/298 |
| 2015/0075729 | A1 * | 3/2015 | Anderson | E06B 9/262 160/193 |
| 2015/0197984 | A1 * | 7/2015 | Anderson | E06B 9/322 160/298 |
| 2016/0010389 | A1 * | 1/2016 | Anderson | E06B 9/322 188/65.1 |
| 2016/0251896 | A1 * | 9/2016 | Anderson | E06B 9/322 160/84.04 |
| 2016/0319594 | A1 * | 11/2016 | Anderson | E06B 9/324 |
| 2016/0356082 | A1 * | 12/2016 | Gilmer | E06B 9/322 |
| 2016/0356083 | A1 * | 12/2016 | Gilmer | E06B 9/304 |
| 2017/0044821 | A1 * | 2/2017 | Anderson | E06B 9/304 |
| 2017/0044822 | A1 * | 2/2017 | Anderson | E06B 9/262 |
| 2017/0218695 | A1 * | 8/2017 | Hsu | E06B 9/262 |
| 2017/0226794 | A1 * | 8/2017 | Huang | E06B 9/322 |
| 2017/0314325 | A1 * | 11/2017 | Anderson | E06B 9/324 |
| 2017/0342770 | A1 * | 11/2017 | Chen | E06B 9/324 |

* cited by examiner

CONTROL DEVICE FOR CORDLESS BLINDS ASSEMBLY

BACKGROUND OF THE INVENTION

1. Fields of the Invention

The present invention relates to a cordless blinds assembly, and more particularly, to a control device located in the bottom box to control the cordless blinds assembly.

2. Descriptions of Related Art

The conventional window blinds assemblies are developed to include several different styles such as Roman shades, blinds assemblies and curtains assemblies. The control and operation of these window blinds assemblies are catalogued into cordless operation devices and cord-operational devices. The control device is received in the top box and connected to the operation cords which hang downward and located on two sides of the blinds. However, the operation cords may be wrapped around limbs of children playing the operation cords.

The present invention intends to provide a control device of a cordless blinds assembly and the control device is received in the bottom box of the blinds assembly to eliminate the shortcomings mentioned above.

SUMMARY OF THE INVENTION

The present invention relates to a cordless blinds assembly and comprises a top box, a bottom box and multiple slats connected between the top box and the bottom box. Multiple cords are connected to the top box and extend through the slats and extend through the cord holes in the top of the bottom box. The bottom box has two fixed plates located therein and located close to two ends of the bottom box. Each of the two fixed plates has a connection tube through which a rectangular hole is defined. The two cord holes are respectively defined through the top of the bottom box and located close to the two ends of the bottom box. Two outlets are defined through the top of the bottom box and located between the two cord holes.

A control device includes a rod unit having an operation unit, multiple scrolling belt units and multiple transmission rods, wherein the operation unit has a first case, a second case, a button, an engaging member and a coil spring plate seat. The first case has a first room defined therein which communicates with an opening at the inside of the first case. A first side hole is defined through the outside wall of the first case. A first pivotal hole is defined in the end face of the top wall of the first case. An engaging plate is located in the first room.

The second case has a second room defined therein which communicates with an opening at the inside and a portion of the top of the second case. A second side hole is defined through the outside wall of the second case. A second pivotal hole is defined through the outside wall of wall of the second case. A stud extends from the top of the front wall of the second room. A resilient member is mounted to the stub. The button has a protrusion extending from the underside thereof.

The engaging member has a contact plate extending from the front thereof, and a pawl is connected to the rear side of the engaging member. Two pivots respectively extend from two sides of the engaging member.

The coil spring plate seat has a central rod which is connected between two restriction plates. A coil spring plate is wrapped around the central rod between the two restriction plates. Each of the two restriction plates has an axial tube extending from the outside thereof. Each axial tube has a rectangular hole defined in the end face thereof. A gear is connected to one of the restriction plates and located between the restriction plate and the axial tube corresponding to the restriction plate. The two axial tubes of the coil spring plate seat are pivotably connected to the first and second side holes. One end of the coil spring plate is engaged with the engaging plate in the first room of the first case. The two pivots of the engaging member are pivotably connected to the first and second pivotal holes. The underside of the contact plate of the engaging member contacts the resilient member on the stub of the second case, and the pawl of the engaging member is engaged with the gear of the coil spring plate seat. The first and second cases are connected to each other at the two respective insides thereof.

The scrolling belt units each have a housing, a cover and a belt wheel, wherein the housing has a first through hole defined in the outside wall thereof. A belt slot is defined in the rear side wall thereof. The cover has a second through hole defined centrally therethrough. A scrolling belt is scrolled to the belt wheel which has a tube extending from each of the two ends thereof. Each of the tubes of the belt wheel has a rectangular hole defined in the end face thereof. The two tubes of the belt wheel respectively extend through the first and second through holes. One end of the scrolling belt extends through the belt slot. The cover is connected to the housing.

Each of the transmission rods has two ends which respectively inserted into the rectangular hole of the coil spring plate seat and the rectangular hole of the scrolling belt unit corresponding thereto. Each of the transmission rods extends through the rectangular hole of the connection tube of the fixed plate corresponding thereto. The cords extend through the cord holes and are connected to the transmission rods. The scrolling belts extend through the outlets and are connected to the top box.

By pushing the button to disengage the pawl of the engaging member from the gear of the coil spring plate seat. When releasing the button, the resilient member pushes the contact plate of the engaging member, and the pawl of the engaging member is engaged with the gear of the coil spring plate seat. The coil spring plate seat of the operation unit drives the transmission rods and the belt wheels of the scrolling belt units by the force created from the coil spring plate so that the blinds assembly is lifted/lowered and positioned. There will be no operation cords needed.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
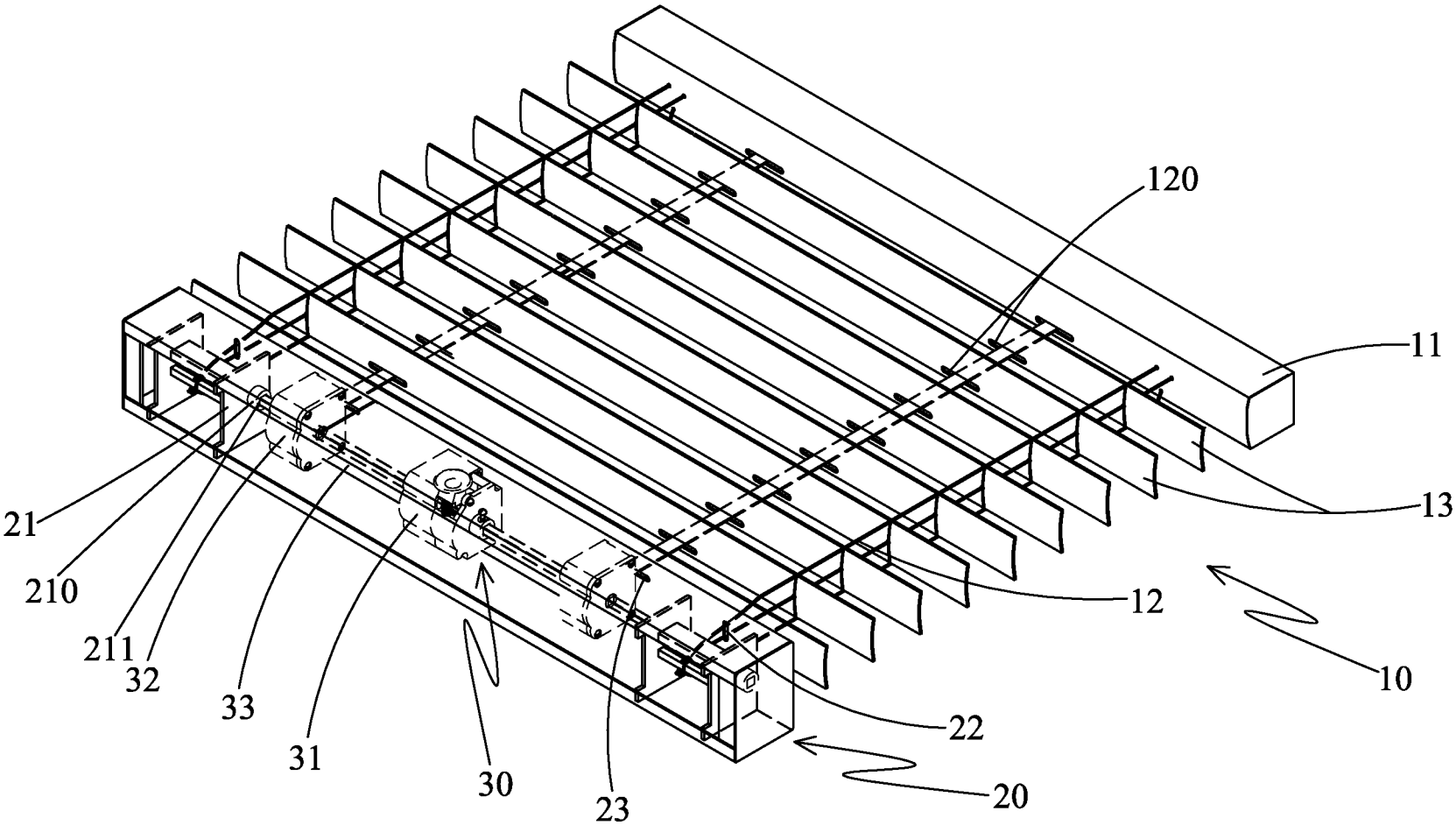
FIG. 1 is a perspective view to show the blinds assembly with the control device of the present invention.
Figure 2:
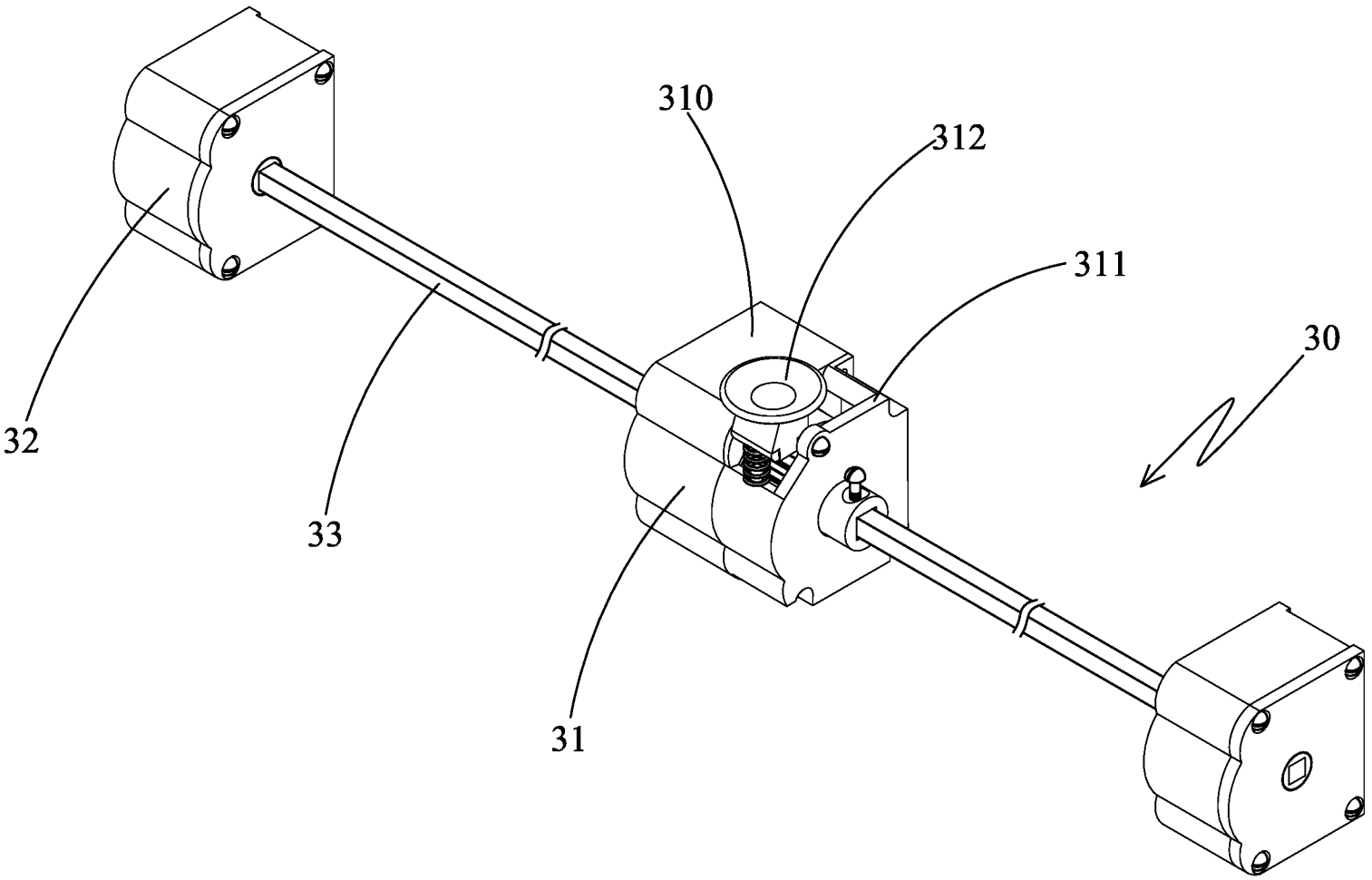
FIG. 2 is a perspective view to show the rod unit of the control device of the present invention.

Referring to FIGS. 1 to 7, the cordless blinds assembly 10 of the present invention comprises a top box 11, a bottom box 20 and multiple slats 13 connected between the top box 11 and the bottom box 20. Multiple cords 12 are connected to the top box 11 and extend through the slats 13 and extend through cord holes 22 defined through the top of the bottom box 20.

The bottom box 20 is located next to the lowest slat 13 and has two fixed plates 21 located therein and located close to two ends of the bottom box 20. Each of the two fixed plates 21 has a connection tube 210 through which a rectangular hole 211 is defined. The two cord holes 22 are respectively defined through the top of the bottom box 20 and located close to the two ends of the bottom box 20. The cords 12 extend through the cord holes 22 and are connected to the transmission rods 33 which will be described later. Two outlets 23 are defined through the top of the bottom box 20 and located between the two cord holes 22.

A control device includes a rod unit 30 which has an operation unit 31, multiple scrolling belt units 32 and multiple transmission rods 33 as mentioned above. In this embodiment, the operation unit 31 is located between the two scrolling belt units 32, and two transmission rods 33 are respectively connected between the operation unit 31 and the two scrolling belt units 32.

The operation unit 31 has a first case 310, a second case 311, a button 312, an engaging member 313 and a coil spring plate seat 314. The first case 310 has a first room 310A defined therein which communicates with an opening at the inside of the first case 310. A first side hole 310B is defined through the outside wall of the first case 310, and a first pivotal hole 310C is defined in the end face of the top wall of the first case 310. An engaging plate 310D is located in the first room 310. The first case 310 of the operation unit 31 has multiple first fixing holes 310E defined along sides of the inside thereof.

Figure 10:
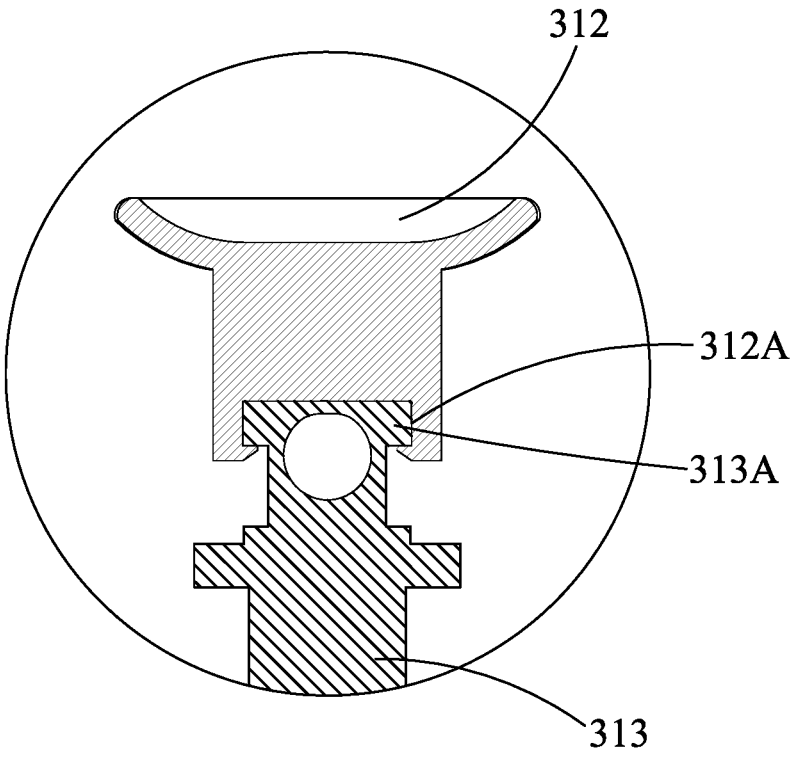
FIG. 10 is a cross sectional view to show the connection of the contact plate of the engaging member and the button of the control device of the present invention.

The second case 311 has a second room 311A defined therein which communicates with an opening 311D at the inside and a portion of the top of the second case 311. A second side hole 311B is defined through the outside wall of the second case 311. A second pivotal hole 311B is defined through the outside wall of wall of the second case 311. A stud 311E extends from the top of the front wall of the second room 311A. A resilient member 311F is mounted to the stub 311E. The button 312 has a protrusion 312A extending from the underside thereof and the protrusion 312A has an engaging slot as shown in FIG. 10. The second case 311 has multiple second fixing holes 311G defined along sides of the inside thereof. Multiple bolts 311H extend through the second fixing holes 311G and are fixed to the first fixing holes 310E.

The engaging member 313 has a contact plate 313A extending from the front thereof, and a pawl 313B is connected to the rear side of the engaging member 313. The contact plate 313A is engaged with the engaging slot of the protrusion 312A as shown in FIG. 10. Two pivots 313C respectively extend from two sides of the engaging member 313.

The coil spring plate seat 314 has a central rod 314A which is connected between two restriction plates 314B. A coil spring plate 314 is wrapped around the central rod 314A between the two restriction plates 314B. Each of the two restriction plates 314B has an axial tube 314D extending from the outside thereof. Each axial tube 314D has an rectangular hole 314E defined in the end face thereof. A gear 314 is connected to one of the restriction plates 314B and located between the restriction plate 314B and the axial tube 314D corresponding to the restriction plate 314B. The two axial tubes 314D of the coil spring plate seat 314 are pivotably connected to the first and second side holes 310B, 311B. One end of the coil spring plate 314C is engaged with the engaging plate 310D in the first room 311A of the first case 311. The two pivots 313C of the engaging member 313 are pivotably connected to the first and second pivotal holes 310C, 311C. The underside of the contact plate 313A of the engaging member 313 contacts the resilient member 311F on the stub 311E of the second case 311, and the pawl 313B of the engaging member 313 is engaged with the gear 314H of the coil spring plate seat 314. The first and second cases 310, 311 are connected to each other at the two respective insides thereof.

The scrolling belt units 32 each have a housing 320, a cover 321 and a belt wheel 322, wherein the housing 320 has a first through hole 320A defined in the outside wall thereof. A belt slot 320B is defined in the rear side wall thereof. The cover 321 has a second through hole 321A defined centrally therethrough. A scrolling belt 322A is scrolled to the belt wheel 322 which has a tube 322B extending from each of the two ends thereof. Each of the tubes 322B of the belt wheel 322 has a rectangular hole 322C defined in the end face thereof. The two tubes of the belt wheel 322 respectively extend through the first and second through holes 320A, 321A. One end of the scrolling belt 322A extends through the belt slot 320B and the slots 120 of the slats 13 and is connected to the top box 11. The housing 320 has multiple connection holes 320C defined along sides of the inside thereof, and the cover 321 has multiple holes 321B. Multiple bolts 321C extend through the holes 321B of the cover 321 and are connected to the connection holes 320C of the housing 320, such that the cover 321 is connected to the housing 320.

Figure 3:
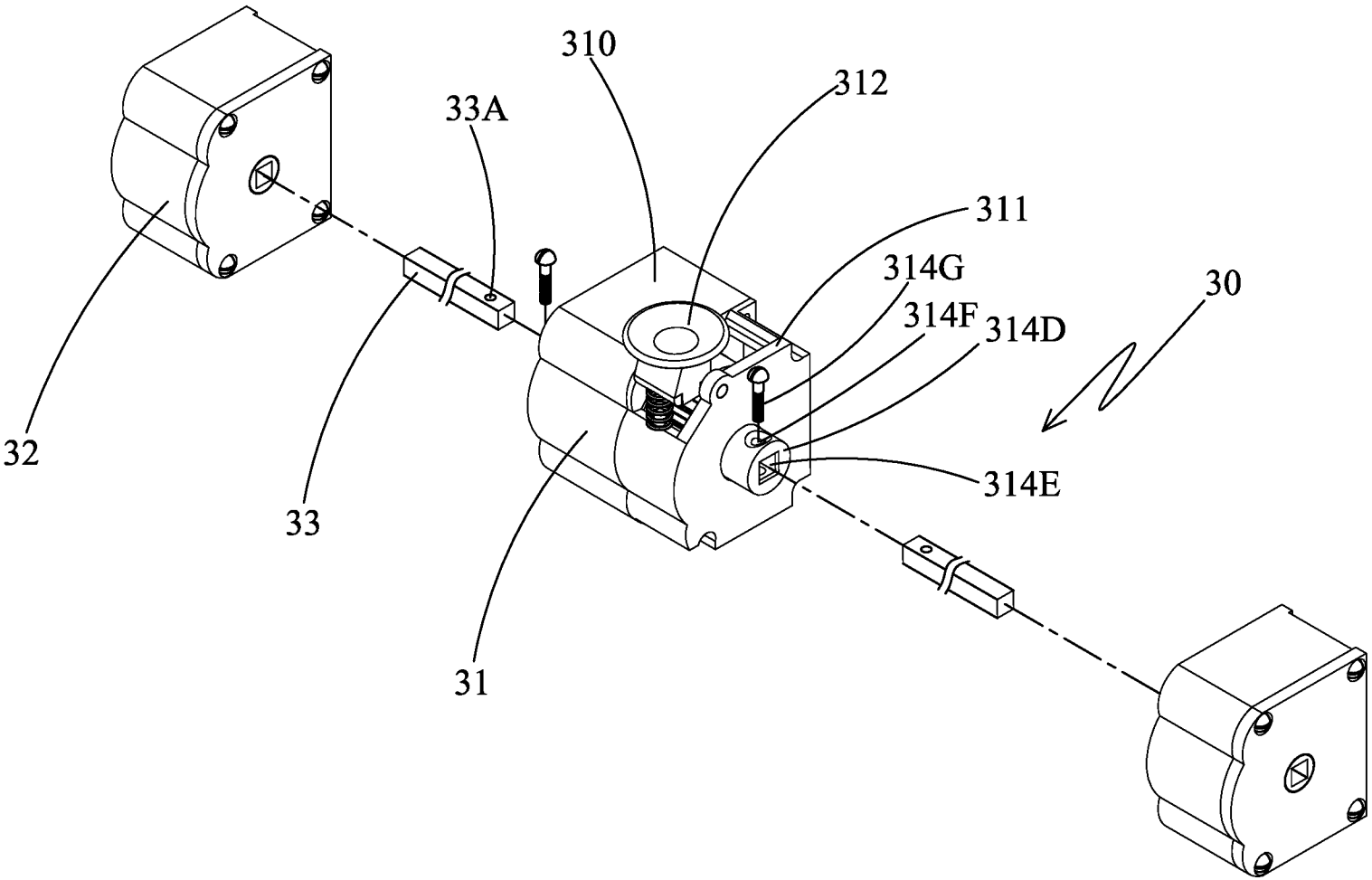
FIG. 3 is an exploded view to show the rod unit of the control device of the present invention.
Figure 4:
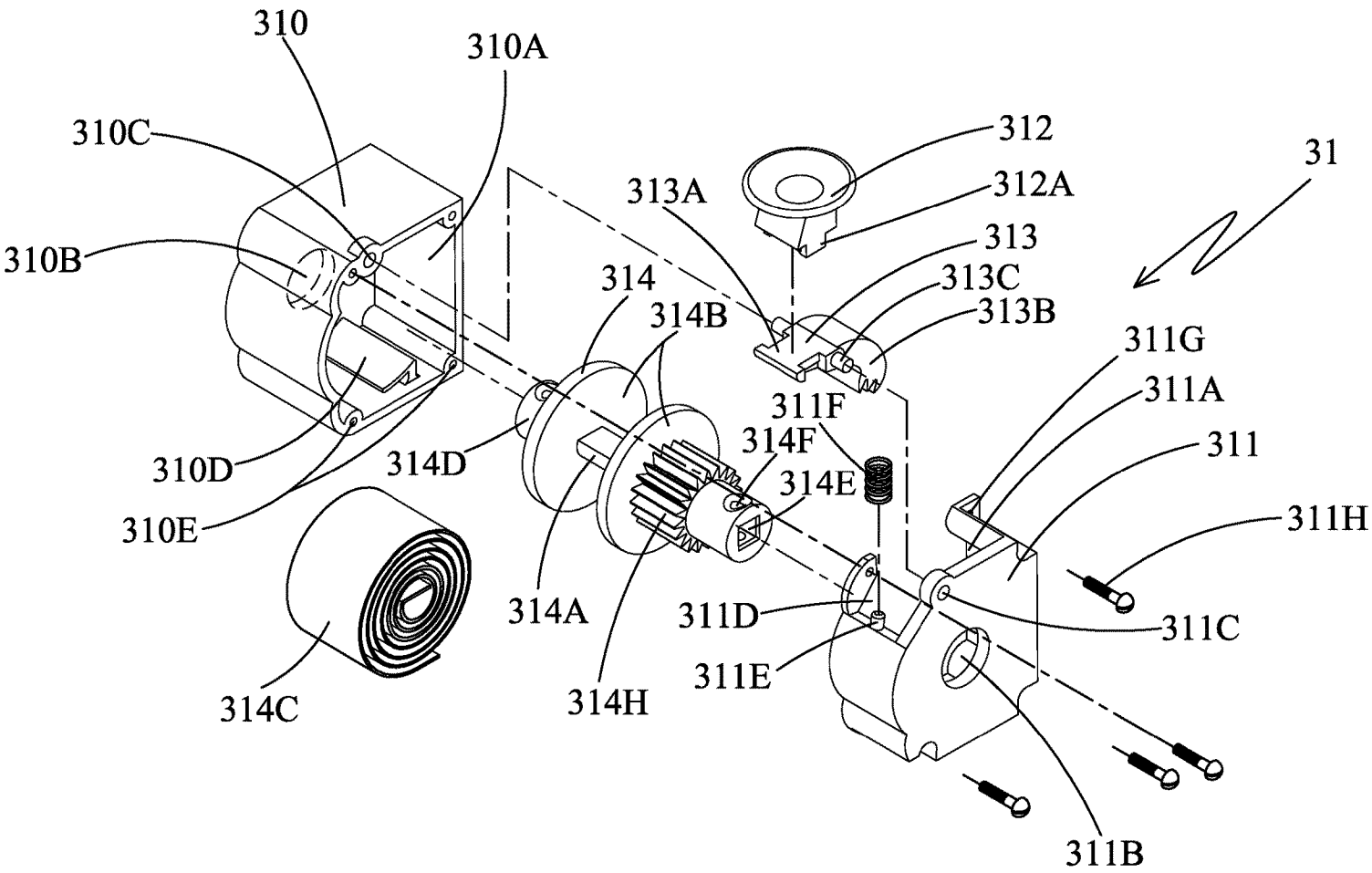
FIG. 4 is an exploded view to show the operation unit of the rod unit of the control device of the present invention.
Figure 5:
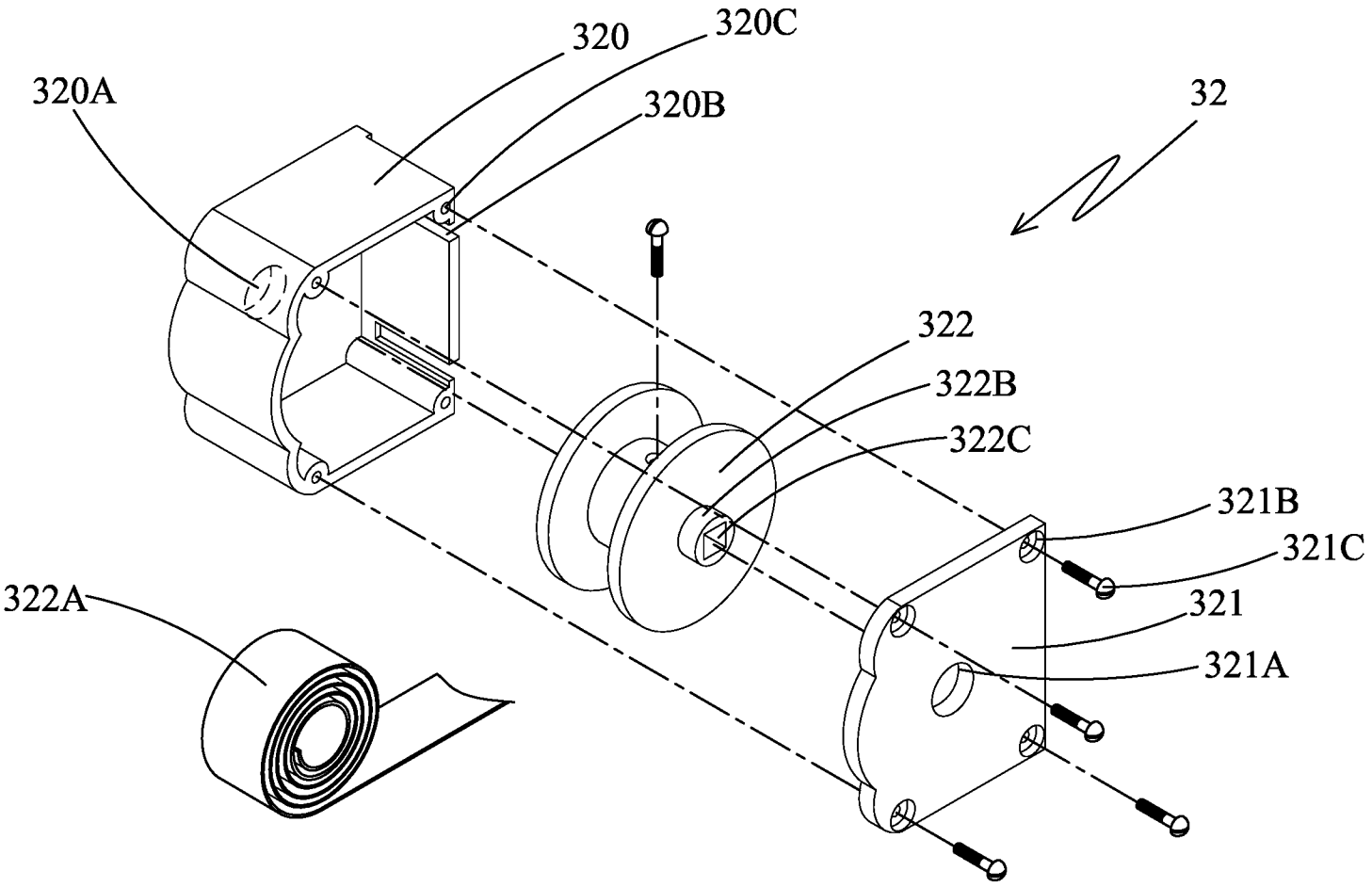
FIG. 5 is an exploded view to show the scrolling belt unit of the rod unit of the control device of the present invention.
Figure 6:
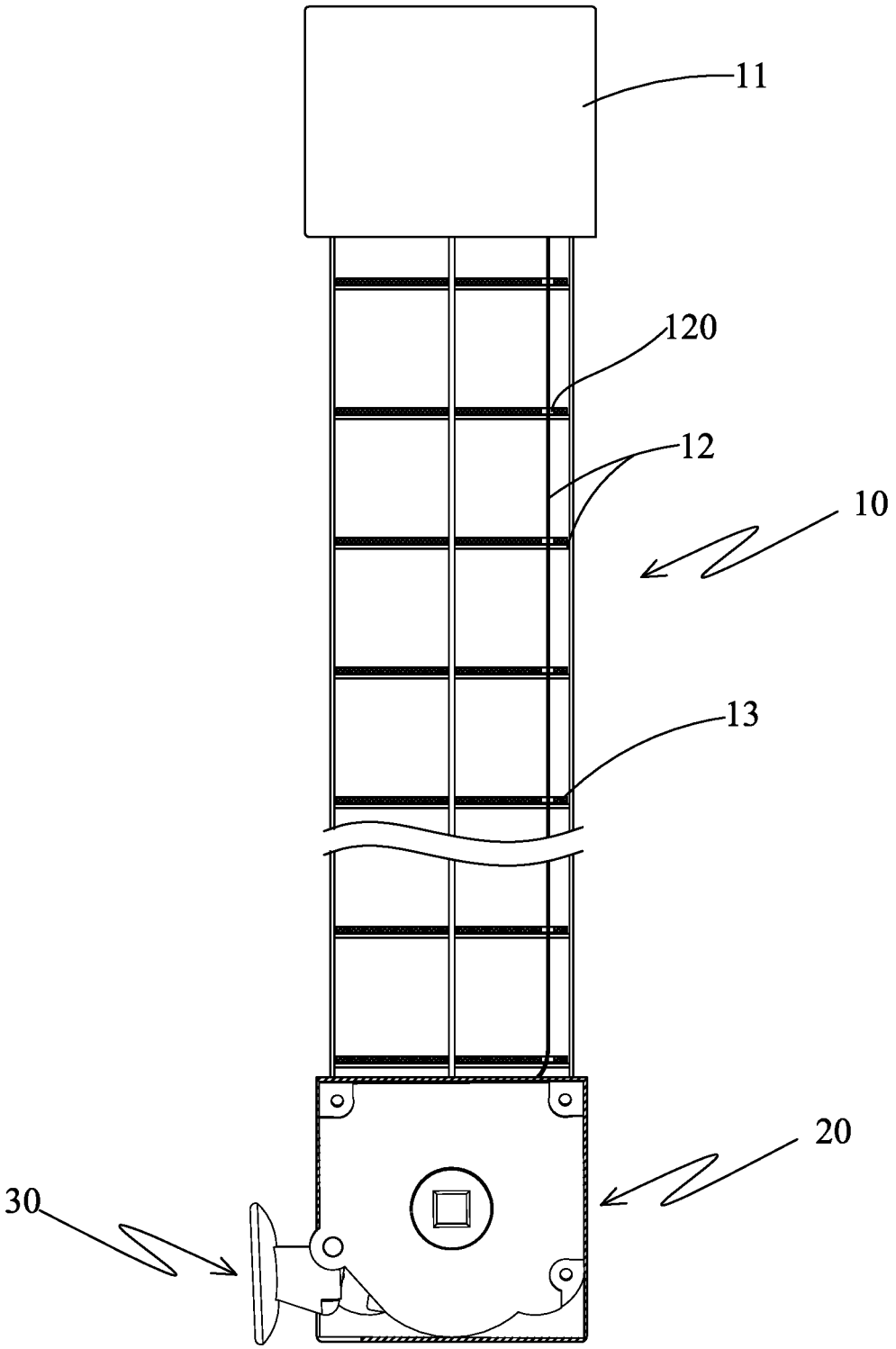
FIG. 6 is a side view to show the blinds assembly with the control device of the present invention.
Figure 7:
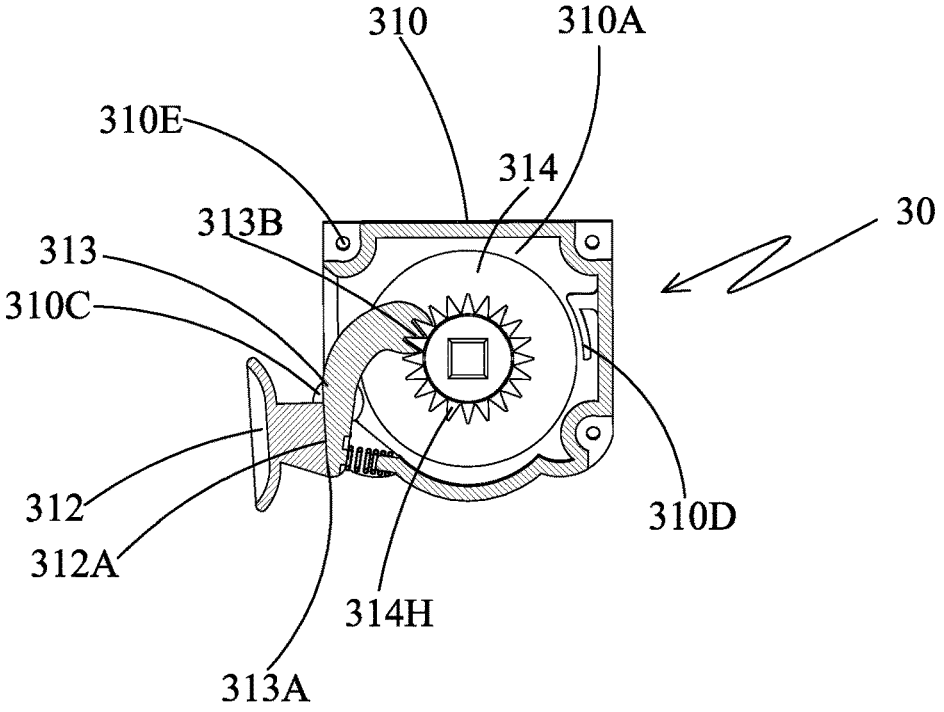
FIG. 7 shows that the pawl of the engaging member is engaged with the gear of the coil spring belt seat of the control device of the present invention.
Figure 8:
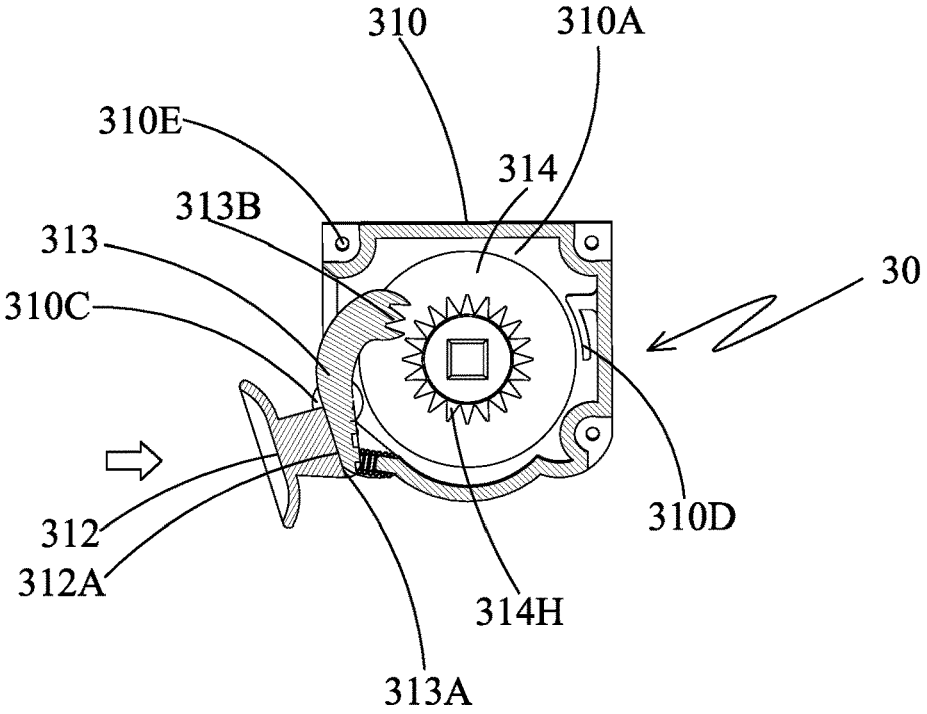
FIG. 8 shows that the pawl of the engaging member is disengaged from the gear of the coil spring belt seat of the control device of the present invention by pushing the button.
Figure 9:
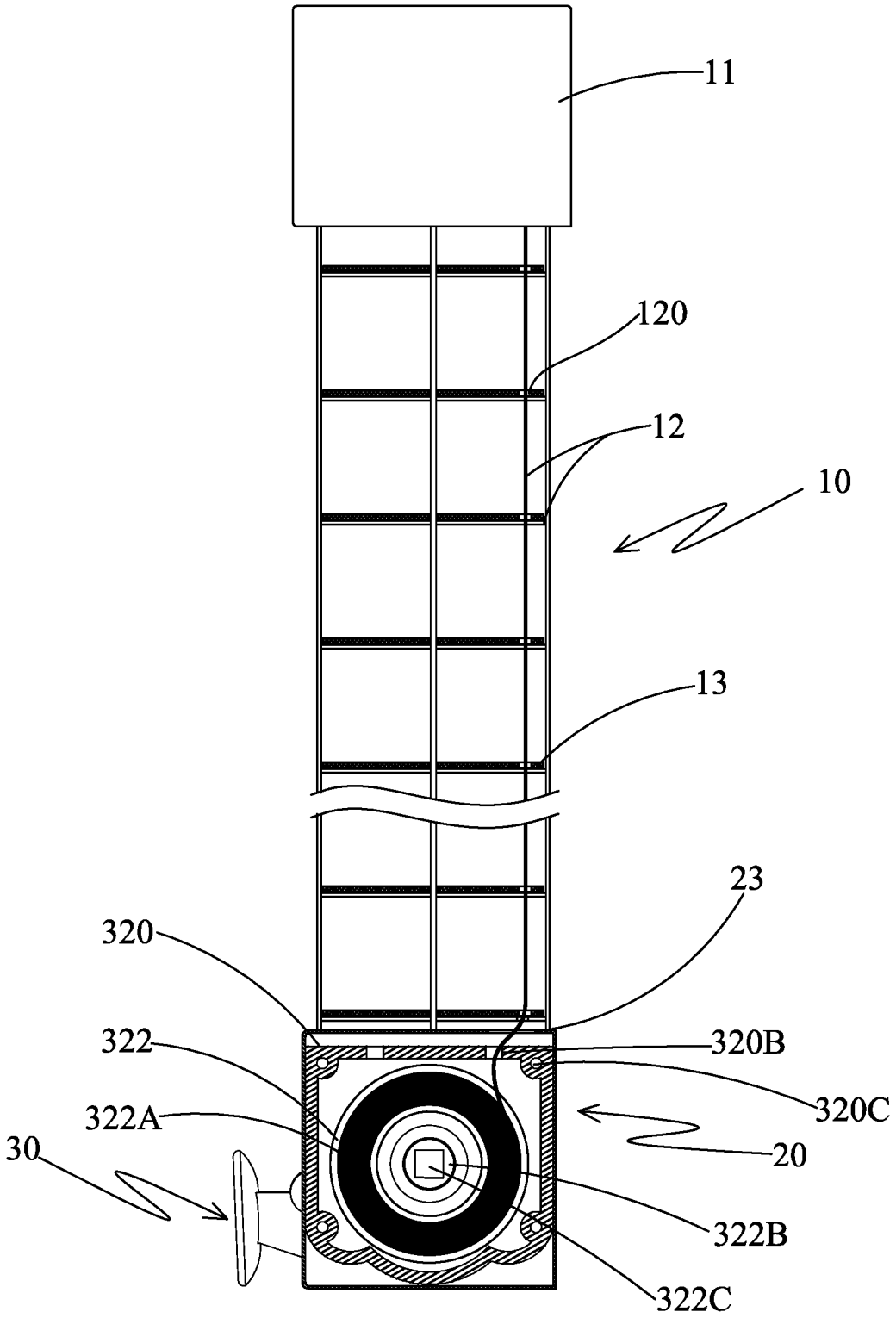
FIG. 9 shows a partial cross sectional view of the control device of the present invention by pushing the button.

Each of the transmission rods 33 has two ends which respectively are inserted into the rectangular hole 314E of the coil spring plate seat 314 and the rectangular hole 322C of the scrolling belt unit 32 corresponding thereto. Each of the transmission rods 33 extends through the rectangular hole 211 of the connection tube 210 of the fixed plate 21 corresponding thereto. The cords 12 extend through the cord holes 22 and are connected to the transmission rods 33. The scrolling belts 322A extend through the outlets 23 and are connected to the top box 11. Each of the two axial tubes 314D of the coil spring plate seat 314 has a radial hole 314F which communicates with the rectangular hole 314E of the axial tube 314D corresponding thereto. A bolt 314G as shown in FIG. 3 extends through each of the radial hole 314F. Each of the transmission rods 33 has a passage 33A defined therethrough in one end thereof which is inserted into the rectangular hole 314E of the axial tube 314D of the coil spring plate seat 314. The bolt 314G extending through the radial hole 314F is connected to the passage 33A.

As shown in FIGS. 7 to 10, when in operation, the user pushes the button 312 to disengage the pawl 313B of the engaging member 313 from the gear 314H of the coil spring plate seat 314. When releasing the button 312, the resilient member 311F pushes the contact plate 313A of the engaging member 313, and the pawl 313B of the engaging member 313 is engaged with the gear 314H of the coil spring plate seat 314. The coil spring plate seat 314 of the operation unit 31 drives the transmission rods 33 and the belt wheels 322 of the scrolling belt units 32 by the force created from the coil spring plate 314C so that the blinds assembly is lifted/lowered and positioned. There will be no operation cords needed.

While we have shown and described the embodiment in accordance with the present invention, it should be clear to those skilled in the art that further embodiments may be made without departing from the scope of the present invention.

What is claimed is:

1. A control device for a cordless blinds assembly, comprising:

a rod unit having an operation unit, two scrolling belt units and two transmission rods, the operation unit having a first case, a second case, a button, an engaging member and a coil spring plate seat, the first case having a first room defined therein which communicates with an opening at an inside of the first case, a first side hole defined through an outside wall of the first case, a first pivotal hole defined in an end face of a top wall of the first case, an engaging plate located in the first room;

the second case having a second room defined therein which communicates with an opening at an inside and a portion of a top of the second case, a second side hole defined through an outside wall of the second case, a second pivotal hole defined through the outside wall of wall of the second case, a stud extending from a top of a front wall of the second room, a resilient member mounted to the stub;

the button having a protrusion extending from an underside thereof;

the engaging member having a contact plate extending from a front thereof, a pawl connected to a rear side of the engaging member, two pivots respectively extending from two sides of the engaging member;

the coil spring plate seat having a central rod which is connected between two restriction plates, a coil spring plate wrapped around the central rod between the two restriction plates, each of the two restriction plates having an axial tube extending from an outside thereof, each axial tube having a rectangular hole defined in an end face thereof, each of the two axial tubes of the coil spring plate seat having a radial hole which communicates with the rectangular hole of the axial tube corresponding thereto, each of the radial holes having a respective bolt extending therethrough, each of the transmission rods having a passage defined therethrough in one end thereof which is inserted into the rectangular hole of the respective axial tube of the coil spring plate seat, the bolt extending through the radial hole being connected to the passage, a gear connected to one of the restriction plates and located between the restriction plate and the axial tube corresponding to the restriction plate, one of the two axial tubes of the coil spring plate seat extending through the first side hole, and the other one of the two axial tubes of the coil spring plate seat extending through the second side hole, an end of the coil spring plate engaged with the engaging plate in the first room of the first case, the two pivots of the engaging member pivotably connected to the first and second pivotal holes, an underside of the contact plate of the engaging member contacting the resilient member on the stub of the second case, the pawl of the engaging member engaged with the gear of the coil spring plate seat, the first and second cases connected to each other at the two respective insides thereof;

the scrolling belt units each having a housing, a cover and a belt wheel, the housing having a first through hole defined in an outside wall thereof, a belt slot defined in a rear side wall thereof, the cover having a second through hole defined centrally therethrough, a scrolling belt scrolled to the belt wheel which has a tube extending from each of two ends thereof, each of the tubes of the belt wheel having a rectangular hole defined in an end face thereof, the two tubes of the belt wheel respectively extending through the first and second through holes, one end of the scrolling belt extending through the belt slot, the cover connected to the housing, and each of the transmission rods having two ends which are respectively inserted into the corresponding rectangular hole of the coil spring plate seat and the corresponding rectangular hole of the scrolling belt unit corresponding thereto, each of the transmission rods adapted to be connected with ropes extending from a top box of the cordless blinds assembly, each of the scrolling belts adapted to be connected to the top box.

2. The control device as claimed in claim 1, wherein the first case of the operation unit has multiple first fixing holes defined along sides of the inside thereof, the second case has multiple second fixing holes defined along sides of the inside thereof, multiple bolts extend through the second fixing holes and are fixed to the first fixing holes.

3. The control device as claimed in claim 1, wherein each of the housings has multiple connection holes defined along sides of the inside thereof, the cover has multiple holes, multiple bolts extend through the holes of the cover and are connected to the connection holes of the housing.

4. A cordless blinds assembly comprising:

a top box, a bottom box and multiple slats connected between the top box and the bottom box, two cords connected to the top box and each cord extending through the slats and extending through a cord hole defined through a top of the bottom box;

the bottom box having two fixed plates located therein and located close to two ends of the bottom box, each of the two fixed plates has a connection tube through which a rectangular hole is defined, the two cord holes respectively defined through the top of the bottom box and located close to the two ends of the bottom box, two outlets defined through the top of the bottom box and located between the two cord holes;

a control device including a rod unit having an operation unit, two scrolling belt units and two transmission rods, the operation unit having a first case, a second case, a button, an engaging member and a coil spring plate seat, the first case having a first room defined therein which communicates with an opening at an inside of the first case, a first side hole defined through an outside wall of the first case, a first pivotal hole defined in an end face of a top wall of the first case, an engaging plate located in the first room;

the second case having a second room defined therein which communicates with an opening at an inside and a portion of a top of the second case, a second side hole defined through an outside wall of the second case, a second pivotal hole defined through the outside wall of wall of the second case, a stud extending from a top of a front wall of the second room, a resilient member mounted to the stub;

the button having a protrusion extending from an underside thereof;

the engaging member having a contact plate extending from a front thereof, a pawl connected to a rear side of the engaging member, two pivots respectively extending from two sides of the engaging member;

the coil spring plate seat having a central rod which is connected between two restriction plates, a coil spring plate wrapped around the central rod between the two restriction plates, each of the two restriction plates having an axial tube extending from an outside thereof, each axial tube having a rectangular hole defined in an end face thereof, a gear connected to one of the restriction plates and located between the restriction plate and the axial tube corresponding to the restriction plate, one of the two axial tubes of the coil spring plate seat extending through the first side hole, and the other one of the two axial tubes of the coil spring plate seat extending through the second side hole, an end of the coil spring plate engaged with the engaging plate in the first room of the first case, the two pivots of the engaging member pivotably connected to the first and second pivotal holes, an underside of the contact plate of the engaging member contacting the resilient member on the stub of the second case, the pawl of the engaging member engaged with the gear of the coil spring plate seat, the first and second cases connected to each other at the two respective insides thereof;

the scrolling belt units each having a housing, a cover and a belt wheel, the housing having a first through hole defined in an outside wall thereof, a belt slot defined in a rear side wall thereof, the cover having a second through hole defined centrally therethrough, a scrolling belt scrolled to the belt wheel which has a tube extending from each of two ends thereof, each of the tubes of the belt wheel having a rectangular hole defined in an end face thereof, the two tubes of the belt wheel respectively extending through the first and second through holes, one end of the scrolling belt extending through the belt slot, the cover connected to the housing, and each of the transmission rods having two ends which are respectively inserted into the corresponding rectangular hole of the coil spring plate seat and the corresponding rectangular hole of the scrolling belt unit corresponding thereto, each of the transmission rods adapted to be connected with ropes extending from a top box of the cordless blinds assembly, each of the scrolling belts adapted to be connected to the top box.

5. The control device as claimed in claim 4, wherein the first case of the operation unit has multiple first fixing holes defined along sides of the inside thereof, the second case has multiple second fixing holes defined along sides of the inside thereof, multiple bolts extend through the second fixing holes and are fixed to the first fixing holes.

6. The control device as claimed in claim 4, wherein each of the housings has multiple connection holes defined along sides of the inside thereof, the cover has multiple holes, multiple bolts extend through the holes of the cover and are connected to the connection holes of the housing.

7. The control device as claimed in claim 4, wherein each of the two axial tubes of the coil spring plate seat has a radial hole which communicates with the rectangular hole of the axial tube corresponding thereto, each of the radial holes has a respective bolt extending therethrough.

8. The control device as claimed in claim 4, wherein each of the transmission rods has a passage defined therethrough in one end thereof which is inserted into the rectangular hole of the respective axial tube of the coil spring plate seat, the bolt extending through the radial hole is connected to the passage.

* * * * *